US011257440B2

(12) United States Patent
Wang et al.

(10) Patent No.: US 11,257,440 B2
(45) Date of Patent: Feb. 22, 2022

(54) DRIVING METHOD INCLUDING A PARTIAL SCREEN DISPLAY MODE, DRIVING CIRCUIT AND DISPLAY DEVICE

(71) Applicant: BOE TECHNOLOGY GROUP CO., LTD., Beijing (CN)

(72) Inventors: Wenbo Wang, Beijing (CN); Yong Yu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 17/255,870

(22) PCT Filed: Feb. 20, 2020

(86) PCT No.: PCT/CN2020/075963

§ 371 (c)(1),
(2) Date: Dec. 23, 2020

(87) PCT Pub. No.: WO2020/173367

PCT Pub. Date: Sep. 3, 2020

(65) Prior Publication Data

US 2021/0264863 A1 Aug. 26, 2021

(30) Foreign Application Priority Data

Feb. 25, 2019 (CN) ..... 201910139090.5

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01)

(58) Field of Classification Search
None
See application file for complete search history.

(56) References Cited

U.S. PATENT DOCUMENTS 6,512,497 B1 * 1/2003 Kondo ..... G09G 3/342 345/1.1
9,847,054 B2 12/2017 Hwang et al.
2016/0293079 A1 10/2016 Kim et al.

FOREIGN PATENT DOCUMENTS

CN 1163444 A 10/1997
CN 1697014 A 11/2006
(Continued)

OTHER PUBLICATIONS

Rejection dated Mar. 26, 2021 corresponding to Chinese application No. 201910139090.5.

(Continued)

*Primary Examiner* — Kirk W Hermann
(74) *Attorney, Agent, or Firm* — Nath, Goldberg & Meyer; Joshua B. Goldberg

(57) ABSTRACT

A driving method including: receiving a partial screen display mode instruction which defines, among the N sub-display regions of the display panel, a first-type sub-display region that is to perform display and a second-type sub-display region that does not perform display; outputting, by the gate driver and according to the partial screen display mode instruction, an operation control signal to a memory to turn off a circuit of the memory associated with a storage space corresponding to the second-type sub-display region; and receiving the display data for the first-type sub-display region, and storing the display data for the first-type sub-display region in a storage space of the memory corresponding to the first-type sub-display region.

16 Claims, 6 Drawing Sheets

(56) References Cited

FOREIGN PATENT DOCUMENTS

| | | | | |
|---|---|---|---|---|
| CN | 101093636 | A | | 12/2007 |
| CN | 101145389 | A | | 3/2008 |
| CN | 101783113 | A | | 7/2010 |
| CN | 202058412 | U | | 11/2011 |
| CN | 104505019 | A | | 4/2015 |
| CN | 106782290 | A | | 5/2017 |
| CN | 107085360 | A | | 8/2017 |
| CN | 108986755 | A | | 12/2018 |
| CN | 109192164 | A | | 1/2019 |
| CN | 109712564 | A | | 5/2019 |
| CN | 106782290 | B | * | 5/2020 |

OTHER PUBLICATIONS

First Office Action with Search Report dated Apr. 24, 2020 corresponding to Chinese application No. 201910139090.5.
Second Office Action with Search Report dated Dec. 18, 2020 corresponding to Chinese application No. 201910139090.5.

* cited by examiner

DRIVING METHOD INCLUDING A PARTIAL SCREEN DISPLAY MODE, DRIVING CIRCUIT AND DISPLAY DEVICE

This is a National Phase Application filed under 35 U.S.C. 371 as a national stage of PCT/CN2020/075963, filed Feb. 20, 2020, an application claiming the benefit of Chinese Application No. 201910139090.5, filed Feb. 25, 2019, the content of each of which is hereby incorporated by reference in its entirety.

TECHNICAL FIELD

The present application belongs to the field of display technology, and particularly relates to a driving method of a display panel, a driving circuit and a display device.

BACKGROUND

Currently, some organic light emitting diode (OLED) display panels (e.g., foldable OLED display panels) need to be switched between a full-screen display mode (in which all rows of pixels perform display) and a partial screen display mode (e.g., in which only an area of half screen performs display). In the existing design, a partial screen display mode is realized by writing black display data into a pixel row which does not perform display, which increases unnecessary power consumption associated with the pixel row, including data storage power consumption, driving power consumption, calculation power consumption and the like.

SUMMARY

According to a first aspect of the present disclosure, there is provided a driving method of a display panel. The display panel includes a plurality of rows of pixels and is divided into N sub-display regions, N being greater than or equal to 2, each of the N sub-display regions includes at least one row of pixels, and the display panel further includes a gate driver including N shift register groups in one-to-one correspondence with the N sub-display regions. The driving method includes: receiving a partial screen display mode instruction which defines, among the N sub-display regions of the display panel, a first-type sub-display region that is to perform display and a second-type sub-display region that does not perform display; outputting, by the gate driver and according to the partial screen display mode instruction, an operation control signal to a memory to turn off a circuit of the memory associated with a storage space corresponding to the second-type sub-display region, the memory being configured to store display data for the first-type sub-display region and display data for the second-type sub-display region of the display panel; receiving the display data for the first-type sub-display region and storing the display data for the first-type sub-display region in a storage space of the memory corresponding to the first-type sub-display region; and generating a data voltage according to the display data for the first-type sub-display region to drive the first-type sub-display region to perform display.

In some embodiments, the driving method further includes: after receiving the partial screen display mode instruction and before receiving the display data for the first-type sub-display region, outputting a gate driver configuration signal to the gate driver according to the partial screen display mode instruction to control a shift register group of the gate driver corresponding to the first-type sub-display region to operate.

In some embodiments, after receiving the partial screen display mode instruction and before outputting the gate driver configuration signal and outputting the operation control signal, the driving method further includes: receiving the display data for the first-type sub-display region and black insertion data for the second-type sub-display region; and generating a data voltage according to the display data for the first-type sub-display region and the black insertion data for the second-type sub-display region to drive the first-type sub-display region and the second-type sub-display region.

In some embodiments, the outputting of the operation control signal to the memory according to the partial screen display mode instruction includes: determining, according to a resolution of the first-type sub-display region, a position of the storage space for storing the display data for the first-type sub-display region; and generating and outputting the operation control signal according to the determined position of the storage space.

In some embodiments, the display panel is an OLED display panel.

According to a second aspect of the present disclosure, there is provided a driving circuit for driving a display panel. The display panel includes a plurality of rows of pixels and is divided into N sub-display regions, N being greater than or equal to 2, each of the N sub-display regions includes at least one row of pixels, and the display panel further includes a gate driver including N shift register groups in one-to-one correspondence with the N sub-display regions. The driving circuit includes: an acquisition sub-circuit configured to receive a partial screen display mode instruction which defines, among the N sub-display regions of the display panel, a first-type sub-display region that is to perform display and a second-type sub-display region that does not perform display; a first configuration sub-circuit configured to output, according to the partial screen display mode instruction, an operation control signal to a memory to turn off a circuit of the memory associated with a storage space corresponding to the second-type sub-display region, the memory being configured to store display data for the first-type sub-display region and display data for the second-type sub-display region of the display panel; a display data reception sub-circuit configured to receive the display data for the first-type sub-display region and store the display data for the first-type sub-display region in a storage space of the memory corresponding to the first-type sub-display region; and a data voltage output sub-circuit configured to generate a data voltage according to the display data for the first-type sub-display region to drive the first-type sub-display region to perform display.

In some embodiments, the driving circuit further includes: a second configuration sub-circuit configured to output a gate driver configuration signal to the gate driver according to the partial screen display mode instruction to control a shift register group of the gate driver corresponding to the first-type sub-display region to operate.

In some embodiments, the display data reception sub-circuit is further configured to: after the acquisition sub-circuit receives the partial screen display mode instruction and before the second configuration sub-circuit outputs the gate driver configuration signal to the gate driver according to the partial screen display mode instruction, receive the display data for the first-type sub-display region and black insertion data for the second-type sub-display region. The data voltage output sub-circuit is further configured to: after the acquisition sub-circuit receives the partial screen display mode instruction and before the second configuration sub-circuit outputs the gate driver configuration signal to the gate driver according to the partial screen display mode instruction, generate a data voltage according to the display data for the first-type sub-display region and the black insertion data for the second-type sub-display region to drive the first-type sub-display region and the second-type sub-display region.

In some embodiments, the first configuration sub-circuit is configured to determine, according to a resolution of the first-type sub-display region, a position of the storage space for storing the display data for the first-type sub-display region, and generate and output the operation control signal according to the determined position of the storage space.

According to a third aspect of the present disclosure, there is provided a display device including a display panel and a driving circuit for driving the display panel.

The display panel includes a plurality of rows of pixels and is divided into N sub-display regions, N being greater than or equal to 2, each of the N sub-display regions includes at least one row of pixels. The display panel further includes a gate driver including N shift register groups in one-to-one correspondence with the N sub-display regions. The driving circuit is the above-mentioned driving circuit.

In some embodiments, the display device further includes an application program terminal configured to output the partial screen display mode instruction to the driving circuit in response to a user operation.

In some embodiments, the application program terminal is further configured to output black insertion data for the second-type sub-display region to the driving circuit during m frames, m being greater than or equal to 1.

In some embodiments, m equals to 1, 2, or 3.

DETAILED DESCRIPTION

Figure 1:
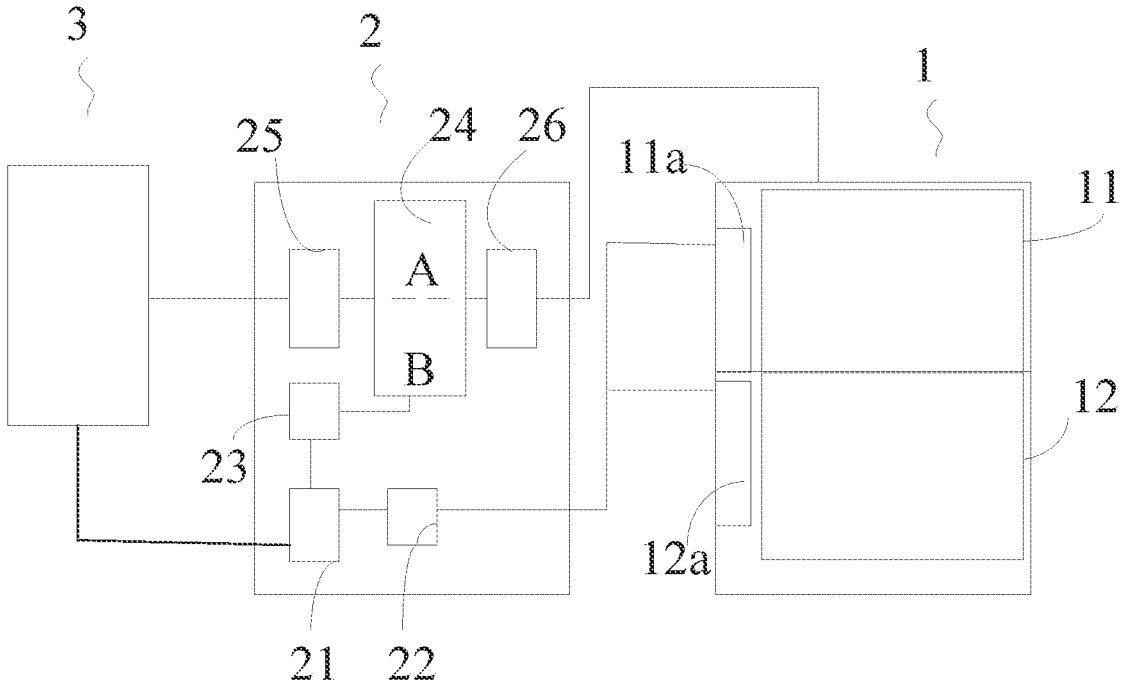
FIG. 1 is a schematic diagram illustrating a structure of a display device according to an embodiment of the present disclosure.

To make those skilled in the art better understand the technical solutions of the present disclosure, the present disclosure will be further described in detail below in conjunction with the accompanying drawings and specific embodiments.

In the related art, an OLED display panel is provided with a plurality of rows of pixels, each row of pixels is provided with one shift register, and all the shift registers are cascaded sequentially in a scanning direction. For example, a shift register outputs a high-level pulse which causes a corresponding row of pixels not to emit light, and during this stage, the driving circuit writes a data voltage to the row of pixels through a data line of the display panel, and then the shift register outputs a low level for most of the time, and the row of pixels keeps emitting light. Each shift register transmits the high-level pulse in turn along the scanning direction, thereby realizing sequential refreshing for each row of pixels.

In one aspect, the present disclosure provides a driving method of a display panel, where the display panel is an OLED display panel. The display panel includes a plurality of rows of pixels and is divided into N sub-display regions along the scanning direction, N being greater than or equal to 2. For example, referring to FIGS. 1 and 2*a*, pixel rows (not particularly shown) in the display panel 1 is divided into a first sub-display region 11 and a second sub-display region 12. The i-th sub-display region includes ni rows of pixels, where $1 \leq i \leq N$. Specifically, each sub-display region may include one or more rows of pixels, and the number of pixel rows in each sub-display region may be equal or different. For example, there are a plurality of rows of pixels in the first sub-display region 11, and a plurality of rows of pixels in the second sub-display region 12.

The display panel 1 further includes a gate driver including N shift register groups in one-to-one correspondence with the sub-display regions. Specifically, each shift register group includes a plurality of shift registers (not particularly shown) that are cascaded and in one-to-one correspondence with the pixel rows in the corresponding sub-display region.

For example, there are 500 rows of pixels in the first sub-display region 11, and correspondingly, the first shift register group 11*a* includes 500 shift registers that are cascaded. There are 500 rows of pixels in the second sub-display region 12, and correspondingly, the second shift register group 12*a* includes 500 shift registers that are cascaded. When these shift registers output an inactive level, data lines (not shown) in the display panel 1 receive data voltages from an external driving circuit 2, and these data voltages are written into respective pixels in corresponding pixel rows during this stage. Then the shift register outputs an active level, the row of pixels emit light with a certain brightness, the magnitude of which is determined by the written data voltage.

The driving method includes the following steps.

At a first step, a partial screen display mode instruction is received, the partial screen display mode instruction defining, among the N sub-display regions of the display panel 1, a first-type sub-display region that is to perform display and a second-type sub-display region that does not perform display.

Figure 2A:
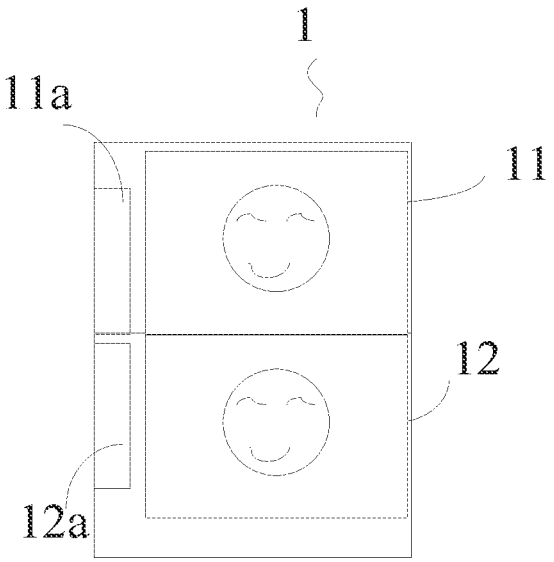
FIGS. 2*a* and 2*b* are schematic diagrams illustrating two display modes of the display device shown in FIG. 1.
Figure 2B:
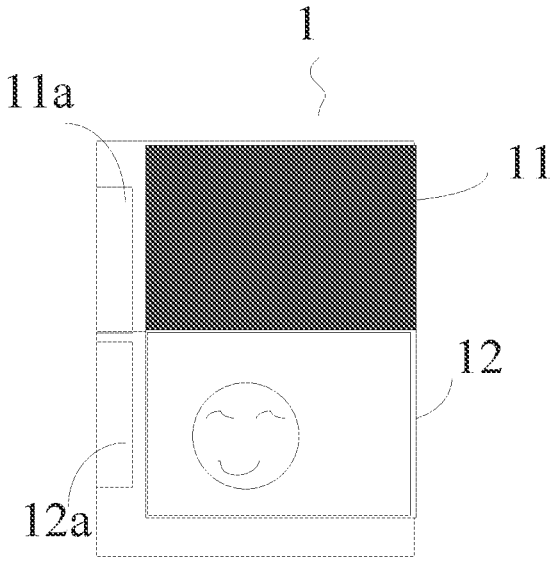

For example, the driving chip for driving the display panel 1 receives a partial screen display mode instruction from a platform chip of a mobile phone. Referring to FIG. 2*b*, the instruction specifies that pixels in the first sub-display region 11 do not perform display, such sub-display region being the second-type sub-display region. The instruction also specifies that pixels in the second sub-display region 12 are to perform display, such sub-display region being the first-type sub-display region. Before receiving the partial screen display mode instruction, the driving chip may drive the first sub-display region 11 and the second sub-display region 12 of the display panel 1 to perform display (i.e., a mode in which all the sub-display regions perform display, which is also called a full-screen display mode), or may drive the first sub-display region 11 of the display panel 1 to perform display and control the second sub-display region 12 not to perform display.

At a second step, a gate driver configuration signal is output to a corresponding gate driver according to the partial screen display mode instruction, so as to control a shift register group of the gate driver corresponding to the first-type sub-display region to operate, and an operation control signal is output to a memory 24 according to the partial screen display mode instruction, so as to turn off a circuit of the memory 24 associated with a storage space corresponding to the second-type sub-display region. For example, in a fourth frame period (bounded by the dashed line) in FIG. 3, a signal having an inactive-level pulse (in this example, the inactive-level pulse is a high-level pulse) denoted as EM2 is applied to the second shift register group 12*a*. The high-level pulse is transferred in the second shift register group 12*a* row by row in the scanning direction. Normal display is performed in the second sub-display region 12. Since the first sub-display region 11 does not need to perform display, it is not necessary to apply the inactive-level pulse to the first shift register group 11*a*. The signal output by a first shift register of the first shift register group is denoted EM1. The first shift register group does not need to operate, so that power consumption can be saved.

The memory 24 may be a memory 24 (e.g., ⅓ RAM, ½ RAM, etc.) integrated in a driving chip of the display panel 1, and has a function of storing display data for a source driving chip or a source driving circuit, for example, such that the source driving chip or the source driving circuit generates corresponding analog voltages according to the display data and provides the analog voltages to the data lines in the display panel 1. For example, the memory 24 may be configured to store display data for the first-type sub-display region and display data for the second-type sub-display region of the display panel.

In this step, the storage space of the memory 24 is only partially accessible (for example, in FIG. 1, the circuit of the memory 24 associated with the storage space denoted by "B" operates) for storing display data required for the sub-display region that is to perform display (for example, the display data required for the second sub-display region 12 in FIG. 2*b*). A circuit of memory 24 associated with other part of storage space (for example, storage space denoted by "A" in the memory 24 in FIG. 1) may be turned off. Turning off the circuit of memory 24 associated with part of storage space can also facilitate saving power consumed by the memory 24.

At a third step, the display data for the first-type sub-display region is received and stored in the storage space of the memory 24 corresponding to the first-type sub-display region.

For example, the driving chip of the display panel 1 receives display data from a platform chip of the mobile phone through the MIPI line. In this case, the data amount of the display data corresponds to only the sub-display region that is to perform display, so that the data amount is reduced, and the power consumption of the driving chip of the display panel 1 and the power consumption of the platform chip of the mobile phone are both reduced.

At a fourth step, a corresponding data voltage is generated according to the display data for the first-type sub-display data so as to drive the first-type sub-display region to perform display.

For example, the source driving chip or the source driving circuit converts the display data as a digital signal into an analog data voltage, and drives the pixel rows in the first-type sub-display region to emit light with corresponding brightness.

In some embodiments, the method further includes the following black insertion step after receiving the partial screen display mode instruction and before outputting the gate driver configuration signal and the operation control signal (i.e., between the first step and the second step).

First, display data for the first-type sub-display region and black insertion data for the second-type sub-display region are received. In this context, black insertion data refers to data that makes a corresponding sub-display region to display black. For example, the display data received by the driving chip from the platform chip of the mobile phone includes both display data for the sub-display region that needs to perform display and black insertion data for the sub-display region that does not need to perform display, that is, the display data of the sub-display region that does not need to perform display is set to black display data. Then, a corresponding data voltage is generated according to the display data for the first-type sub-display region and the black insertion data for the second-type sub-display region to drive the first-type sub-display region and the second-type sub-display region. In this manner, the display abnormality is prevented from occurring when the display panel 1 is switched from other display mode to the next partial screen display mode.

In some embodiments, the outputting of the operation control signal to the memory 24 according to the partial screen display mode instruction includes, determining, according to a resolution of the first-type sub-display region, a position of a storage space for storing the display data for the first-type sub-display region, and generating and outputting the corresponding operation control signal according to the determined position of the storage space.

For example, the first-type sub-display region is the second sub-display region 12 in FIG. 2*b*, the resolution of which is 500×1000 (i.e., 500 rows and 1000 columns). On the basis of the above, a starting position of the storage space of the memory 24 where the corresponding display data needs to be stored and the capacity of the required storage space are determined, and the storage space of the memory 24 where the display data needs to be stored is controlled to operate based on the starting position and the capacity, and the storage space where the display data does not need to be stored is inaccessible.

It should be noted that, the position of space of the memory 24 corresponding to each sub-display region may be fixed in advance, and a lookup table may be set accordingly. The lookup table specifies positions of the storage space in the memory 24 that needs to be accessible or inaccessible in each display mode.

In another aspect, an embodiment of the present disclosure provides a driving circuit for driving a display panel, where the display panel is an OLED display panel.

The display panel includes a plurality of rows of pixels and is divided into N sub-display regions in a scanning direction. N being greater than or equal to 2, the i-th sub-display region includes at least one row of pixels, $1 \leq i \leq N$, and the display panel further includes a gate driver including N shift register groups in one-to-one correspondence with the N sub-display regions. Specifically, each shift register group includes a plurality of shift registers that are cascaded and in one-to-one correspondence with the pixel rows in the corresponding sub-display region. The structure of the display panel may refer to the description of the above embodiments. Referring to FIG. 1, the driving circuit 2 may include an acquisition sub-circuit 21, a first configuration sub-circuit 23, a display data reception sub-circuit 25, and a data voltage output sub-circuit 26. In some embodiments, the driving circuit 2 may further include a second configuration sub-circuit 22.

The acquisition sub-circuit 21 is configured to receive a partial screen display mode instruction which defines, among the N sub-display regions of the display panel 1, a first-type sub-display region that is to perform display and a second-type sub-display region that does not perform display.

For example, a 3-bit register RMR is provided in a driving chip of the display panel 1, and the platform chip of the mobile phone sends a display mode switching instruction to the driving chip. The following table shows the meanings of these instructions. For example, if the platform chip of the mobile phone sends an instruction "000" to the driving chip of the display panel 1, the driving chip drives the display panel 1 to switch from the full-screen display mode shown in FIG. 2*a* to the partial-screen display mode. In this table, "A" denotes that only the first sub-display region 11 in FIG. 1 performs display, "B" denotes that only the second sub-display region 12 in FIG. 1 performs display (i.e., the scenario shown in FIG. 2*b*), and "A+B" denotes that both the first sub-display region 11 and the second sub-display region 12 in FIG. 1 perform display.

| RMR | display mode switching |
|---|---|
| 000 | A + B → B |
| 001 | B → A + B |
| 010 | A → B |
| 011 | B → A |
| 100 | A + B → A |
| 110 | A + B → A |
| 101 | A → A + B |
| 111 | A → A + B |

According to the instruction "000" and the predetermined mapping relationship, it can be known that the switching of the display mode from the "A+B" mode (in this case, the first-type sub-display region refers to the first sub-display region 11 and the second sub-display region 12) to the "B" mode (in this case, the first-type sub-display region only includes the second sub-display region 12) is about to be completed.

The second configuration sub-circuit 22 is configured to output a corresponding gate driver configuration signal to the gate driver according to the partial screen display mode instruction, so as to control a shift register group of the gate driver corresponding to the first-type sub-display region to operate.

The first configuration sub-circuit 23 is configured to output, according to the partial screen display mode instruction, an operation control signal to the memory 24, so as to turn off a circuit of the memory 24 associated with a storage space corresponding to the second-type sub-display region.

The display data reception sub-circuit 25 is configured to receive the display data for the first-type sub-display region and store the display data for the first-type sub-display region in a storage space of the memory corresponding to the first-type sub-display region.

The data voltage output sub-circuit 26 is configured to generate a data voltage according to the display data for the first-type sub-display region so as to drive the first-type sub-display region to perform display.

In some embodiments, the display data reception sub-circuit 25 of the gate driver is further configured to: after the acquisition sub-circuit 21 receives the partial screen display mode instruction and before the second configuration sub-circuit 22 outputs the corresponding gate driver configuration signal to the gate driver according to the partial screen display mode instruction, receive the display data for the first-type sub-display region and black insertion data for the second-type sub-display region. In some embodiments, the data voltage output sub-circuit 26 is further configured to: after the acquisition sub-circuit 21 receives the partial screen display mode instruction and before the second configuration sub-circuit 22 outputs the corresponding gate driver configuration signal to the gate driver according to the partial screen display mode instruction, generate a data voltage according to the display data for the first-type sub-display region and the black insertion data for the second-type sub-display region to drive the first-type sub-display region and the second-type sub-display region.

In some embodiments, the first configuration sub-circuit 23 is configured to determine, according to a resolution of the first-type sub-display region, a position of a storage space for storing the display data for the first-type sub-display region, and generate and output the operation control signal according to the determined position of the storage space.

In another aspect, an embodiment of the present disclosure provides a display device, including the display panel 1 and the driving circuit 2 for driving the display panel 1. The display panel 1 is an OLED display panel 1, and includes a plurality of rows of pixels and is divided into N sub-display regions in the scanning direction, N being greater than or equal to 2, and an i-th sub-display region includes ni rows of pixels, where $1 \leq i \leq N$. The display panel 1 further includes a gate driver including N shift register groups in one-to-one correspondence with the N sub-display regions. Specifically, each shift register group includes a plurality of shift registers that are cascaded and in one-to-one correspondence with the pixel rows in the corresponding sub-display region. The description of the display panel 1 and the driving circuit 2 refers to the above-described embodiments.

In some embodiments, the display device further includes an application program terminal 3 configured to output a partial screen display mode instruction to the driving circuit 2 in response to a user operation. The application program terminal 3 is implemented as a platform chip of a mobile phone, for example.

In some embodiments, the display data reception sub-circuit 25 of the gate driver is further configured to: after the acquisition sub-circuit 21 receives the partial screen display mode instruction and before the second configuration sub-circuit 22 outputs the corresponding gate driver configuration signal to the gate driver according to the partial screen display mode instruction, receive the display data for the first-type sub-display region and black insertion data for the second-type sub-display region. In some embodiments, the data voltage output sub-circuit 26 is further configured to: after the acquisition sub-circuit 21 receives the partial screen display mode instruction and before the second configuration sub-circuit 22 outputs the corresponding gate driver configuration signal to the gate driver according to the partial screen display mode instruction, generate a data voltage according to the display data for the first-type sub-display region and the black insertion data for the second-type sub-display region to drive the first-type sub-display region and the second-type sub-display region, and the application program terminal 3 is further configured to output black insertion data for the second-type sub-display region to the driving circuit 2 during m frames, m being greater than or equal to 1.

In some embodiments, m equals to 1, 2, or 3. The number of frames for black insertion does not need to be too large to reduce power consumption.

Specifically, the display device can be any product or component with a display function, such as an OLED display module, a mobile phone, a tablet computer, a television, a display, a laptop computer, a digital photo frame, a navigator and the like.

Figure 3:
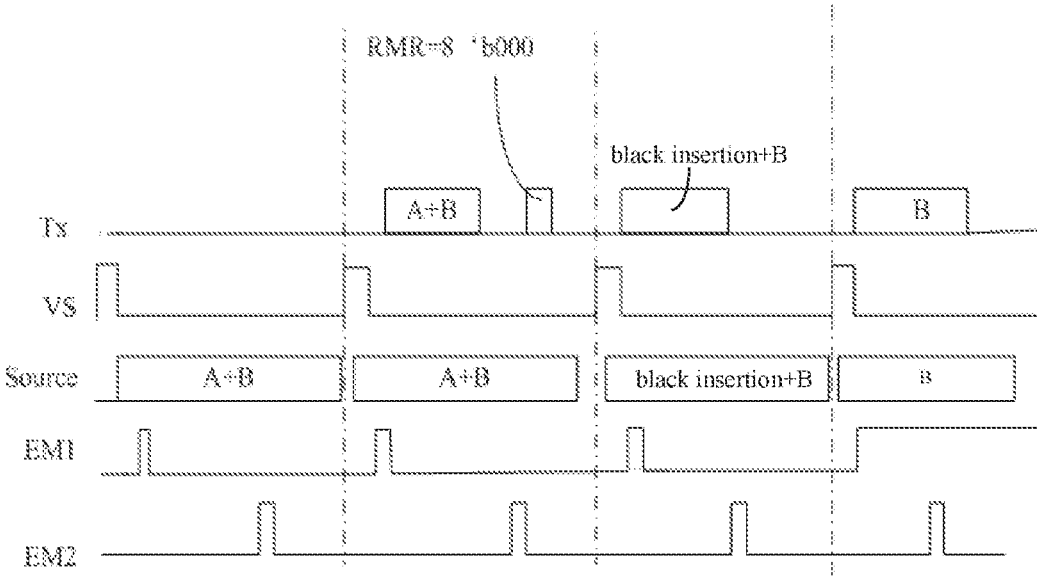
FIG. 3 is a timing diagram of a driving process of a display panel according to an embodiment of the present disclosure.
Figure 4:
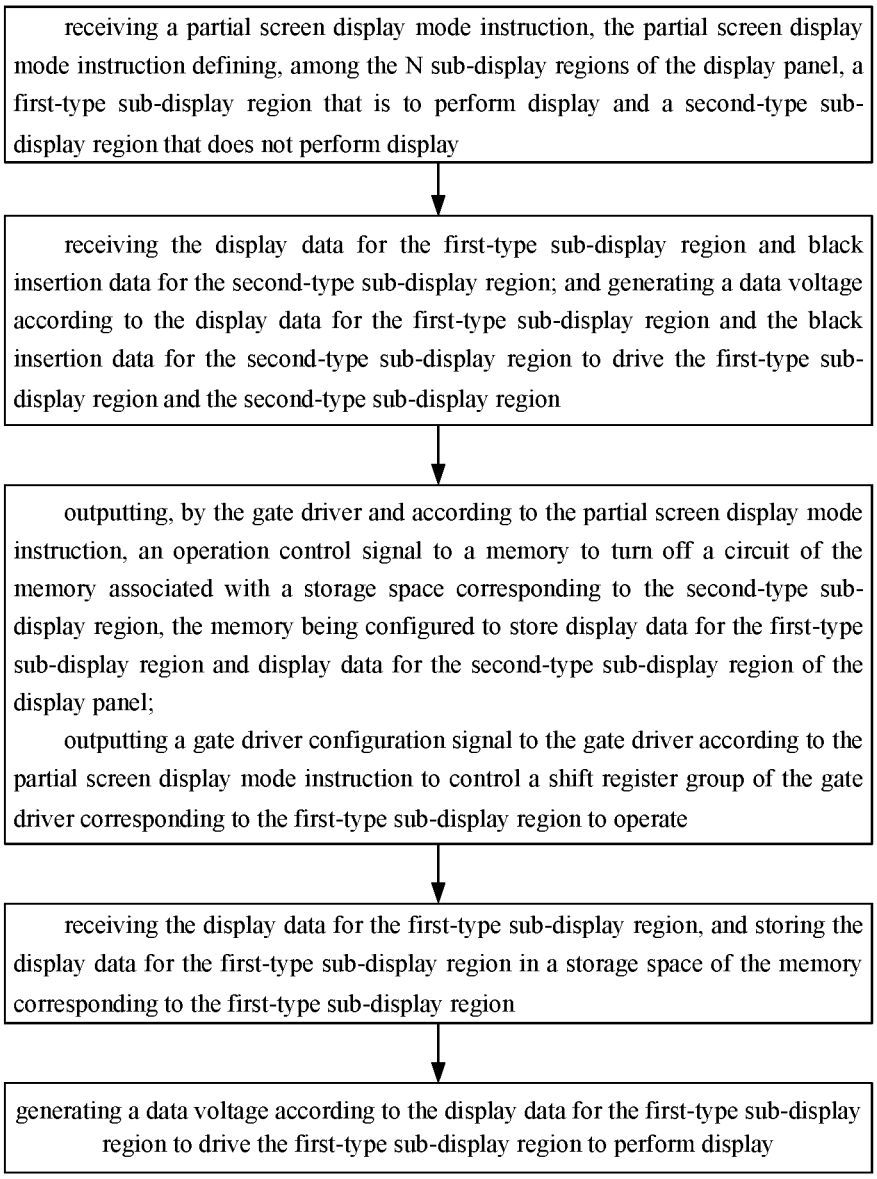
FIG. 4 is a flow chart of a driving method of a display panel according to an embodiment of the present disclosure.
Figure 5:
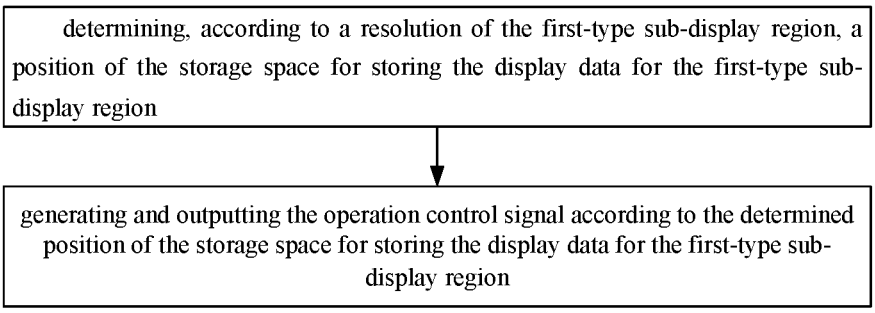
FIG. 5 is a flow chart illustrating the outputting of the operation control signal to the memory as shown in FIG. 4, according to an embodiment of the present disclosure.
Figure 6:
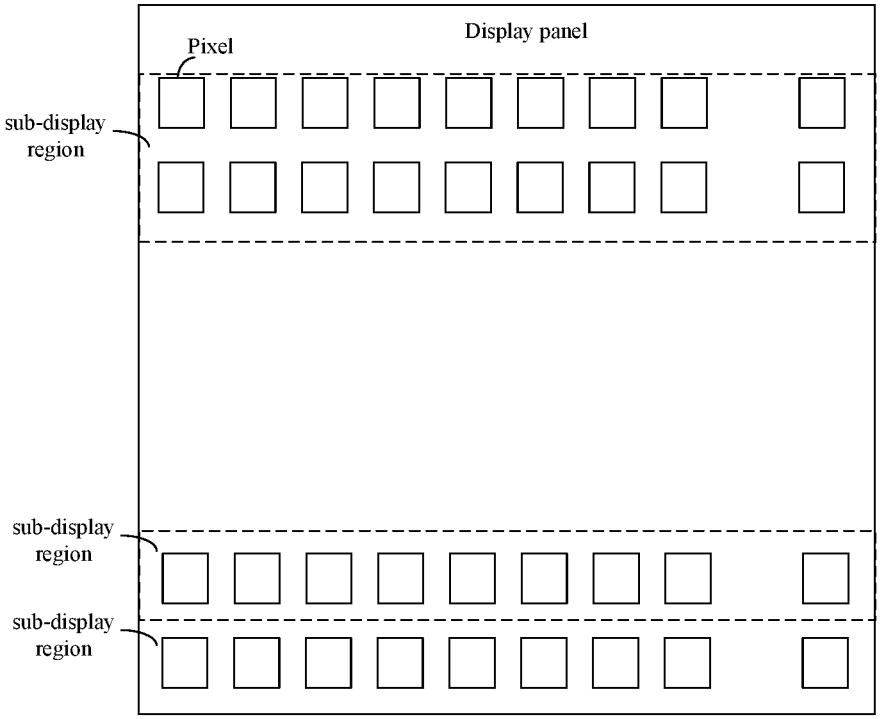
FIG. 6 is a schematic diagram illustrating a display panel according to an embodiment of the present disclosure.
Figure 7:
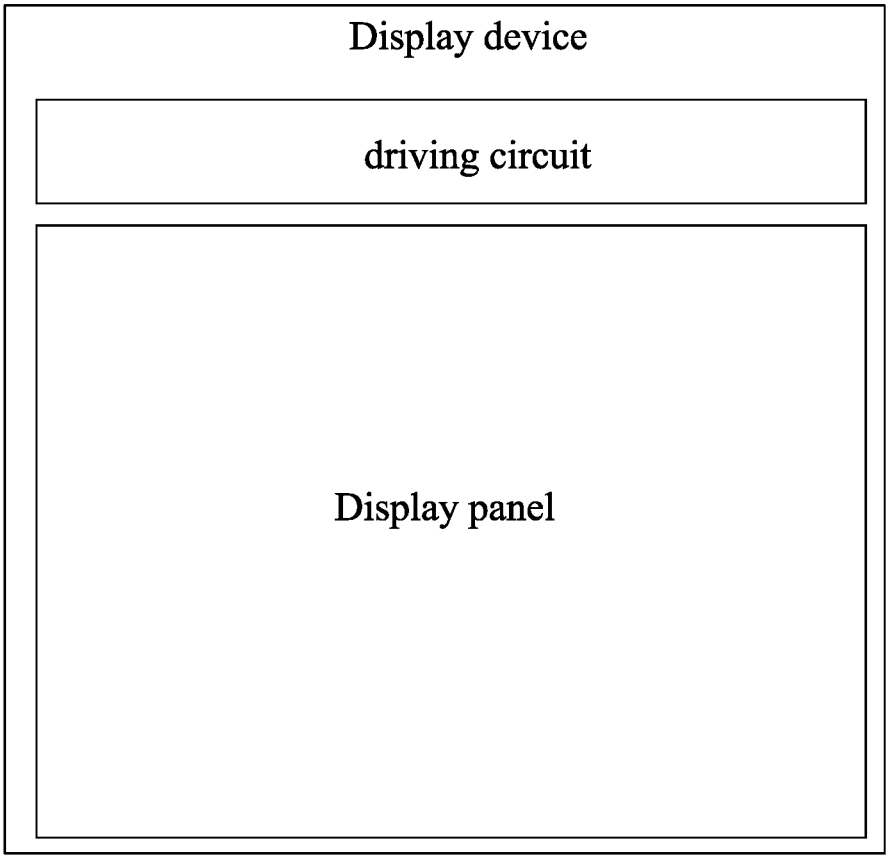
FIG. 7 is a schematic diagram illustrating a display device according to an embodiment of the present disclosure.

An example of an operation timing of the display device is described below with reference to FIG. 3. In first and second frame periods, the display panel 1 operates in the full-screen display mode; in a third frame period, the first sub-display region 11 of the display panel 1 displays a pure black image, the second sub-display region 12 displays an image to be displayed (for example, an image of a smiling face); and in a fourth frame period and subsequent frame period(s), the display panel 1 operates in an operation state in which only the second sub-display region 12 performs display.

In the first frame period, the platform chip of the mobile phone outputs full-screen display data Tx to the driving chip of the display panel 1. The driving chip outputs to the display panel 1 a start signal VS indicating the start of one frame. The memory 24 of the driving chip stores therein display data required for the first sub-display region 11 and the second sub-display region 12, and outputs the display data to the data lines of the display panel 1 through the source driving circuit (in the drawings, signal data output to the data lines are denoted as "Source"). The first shift register of the first shift register group 11*a* receives a high-level pulse (in the drawings, the signal received by the first shift register of the first shift register group 11*a* is denoted as EM1), during which the writing operation of the data voltage to the first row of pixels by the driving chip is completed. The high-level pulse is then transmitted to a second shift register of the first shift register group 11*a* (corresponding timing thereof is not shown in FIG. 3), and display data is written into the second row of pixels in the first sub-display region 11. After all the rows of pixels in the first sub-display region 11 are refreshed, the first row of pixels in the second sub-display region 12 starts to receive the high-level pulse, and during this period, the data writing operation of the first row of pixels in the second sub-display region 12 is completed. Thereafter, display data is written into the second row of pixels in the second sub-display region, so on and so forth.

In the second frame period, the display panel 1 still operates in the full-screen display mode, but the platform chip of the mobile phone sends an instruction to the driving chip of the display panel 1 to inform the driving chip to enter the mode in which only the second sub-display region 12 performs display. For example, an instruction "000" is written into the RMR register.

In the third frame period, the platform chip of the mobile phone outputs full-screen display data to the driving chip of the display panel 1, which differs from the full-screen display data for the first frame period in that the display data corresponding to the first sub-display region 11 is pure black display data (i.e., black insertion data). For example, referring to FIG. 2*b*, the display panel 1 displays a half-screen black image and a half-screen image of a smiling face.

In the fourth frame period, the platform chip of the mobile phone outputs only the display data required for the second sub-display region 12 to the driving chip of the display panel 1, and the memory 24 of the driving chip stores only this part of the display data, while the circuit of the memory associated with remaining storage space is turned off.

It can be understood that the foregoing embodiments are merely exemplary embodiments used for describing the principle of the present disclosure, but the present disclosure is not limited thereto. Those of ordinary skill in the art may make various variations and improvements without departing from the spirit and essence of the present invention, and these variations and improvements shall also fall into the protection scope of the present disclosure.

What is claimed is:

1. A driving method of a display panel, the display panel comprising a plurality of rows of pixels and being divided into N sub-display regions, N being greater than or equal to 2, each of the N sub-display regions comprising at least one row of pixels, and the display panel further comprising a gate driver which includes N shift register groups in one-to-one correspondence with the N sub-display regions, the driving method comprising:

receiving a partial screen display mode instruction, the partial screen display mode instruction defining, among the N sub-display regions of the display panel, a first-type sub-display region that is to perform display and a second-type sub-display region that does not perform display;

outputting, by the gate driver and according to the partial screen display mode instruction, an operation control signal to a memory to turn off a circuit of the memory associated with a storage space corresponding to the second-type sub-display region, the memory being configured to store display data for the first-type sub-display region and display data for the second-type sub-display region of the display panel;

receiving the display data for the first-type sub-display region, and storing the display data for the first-type sub-display region in a storage space of the memory corresponding to the first-type sub-display region; and generating a data voltage according to the display data for the first-type sub-display region to drive the first-type sub-display region to perform display.

2. The driving method of claim 1, further comprising:

after receiving the partial screen display mode instruction and before receiving the display data for the first-type sub-display region, outputting a gate driver configuration signal to the gate driver according to the partial screen display mode instruction to control a shift register group of the gate driver corresponding to the first-type sub-display region to operate.

3. The driving method of claim 2, further comprising: after receiving the partial screen display mode instruction and before outputting the gate driver configuration signal and outputting the operation control signal, receiving the display data for the first-type sub-display region and black insertion data for the second-type sub-display region; and generating a data voltage according to the display data for the first-type sub-display region and the black insertion data for the second-type sub-display region to drive the first-type sub-display region and the second-type sub-display region.

4. The driving method of claim 1, wherein the outputting of the operation control signal to the memory according to the partial screen display mode instruction comprises:

determining, according to a resolution of the first-type sub-display region, a position of the storage space for storing the display data for the first-type sub-display region, and generating and outputting the operation control signal according to the determined position of the storage space for storing the display data for the first-type sub-display region.

5. The driving method of claim 1, wherein the display panel is an organic light emitting diode (OLED) display panel.

6. A driving circuit for driving a display panel, the display panel comprising a plurality of rows of pixels and being divided into N sub-display regions, N being greater than or equal to 2, each of the N sub-display regions comprising at least one row of pixels, and the display panel further comprising a gate driver which comprises N shift register groups in one-to-one correspondence with the N sub-display regions, the driving circuit comprising:

an acquisition sub-circuit configured to receive a partial screen display mode instruction defining, among the N sub-display regions of the display panel, a first-type sub-display region that is to perform display and a second-type sub-display region that does not perform display;

a first configuration sub-circuit configured to output, according to the partial screen display mode instruction, an operation control signal to a memory to turn off a circuit of the memory associated with a storage space corresponding to the second-type sub-display region, the memory being configured to store display data for the first-type sub-display region and display data for the second-type sub-display region of the display panel;

a display data reception sub-circuit configured to receive the display data for the first-type sub-display region and store the display data for the first-type sub-display region in a storage space of the memory corresponding to the first-type sub-display region; and a data voltage output sub-circuit configured to generate a data voltage according to the display data for the first-type sub-display region to drive the first-type sub-display region to perform display.

7. The driving circuit of claim 6, further comprising:

a second configuration sub-circuit configured to output a gate driver configuration signal to the gate driver according to the partial screen display mode instruction to control a shift register group of the gate driver corresponding to the first-type sub-display region to operate.

8. The driving circuit of claim 7, wherein the display data reception sub-circuit is further configured to: after the acquisition sub-circuit receives the partial screen display mode instruction and before the second configuration sub-circuit outputs the gate driver configuration signal to the gate driver according to the partial screen display mode instruction, receive the display data for the first-type sub-display region and black insertion data for the second-type sub-display region, and the data voltage output sub-circuit is further configured to: after the acquisition sub-circuit receives the partial screen display mode instruction and before the second configuration sub-circuit outputs the gate driver configuration signal to the gate driver according to the partial screen display mode instruction, generate a data voltage according to the display data for the first-type sub-display region and the black insertion data for the second-type sub-display region to drive the first-type sub-display region and the second-type sub-display region.

9. The driving circuit of claim 6, wherein the first configuration sub-circuit is configured to determine, according to a resolution of the first-type sub-display region, a position of the storage space for storing the display data for the first-type sub-display region, and generate and output the operation control signal according to the determined position of the storage space for storing the display data for the first-type sub-display region.

10. A display device, comprising a display panel and a driving circuit for driving the display panel, wherein the display panel comprises a plurality of rows of pixels and is divided into N sub-display regions, N being greater than or equal to 2, each of the N sub-display regions comprises at least one row of pixels, the display panel further comprises a gate driver comprising N shift register groups in one-to-one correspondence with the N sub-display regions, and the driving circuit is the driving circuit of claim 6.

11. The display device of claim 10, wherein the driving circuit further comprises:

a second configuration sub-circuit configured to output a gate driver configuration signal to the gate driver according to the partial screen display mode instruction to control a shift register group of the gate driver corresponding to the first-type sub-display region to operate.

12. The display device of claim 11, wherein the display data reception sub-circuit is further configured to: after the acquisition sub-circuit receives the partial screen display mode instruction and before the second configuration sub-circuit outputs the gate driver configuration signal to the gate driver according to the partial screen display mode instruction, receive the display data for the first-type sub-display region and black insertion data for the second-type sub-display region, and the data voltage output sub-circuit is further configured to: after the acquisition sub-circuit receives the partial screen display mode instruction and before the second configuration sub-circuit outputs the gate driver configuration signal to the gate driver according to the partial screen display mode instruction, generate a data voltage according to the display data for the first-type sub-display region and the black insertion data for the second-type sub-display region to drive the first-type sub-display region and the second-type sub-display region.

13. The display device of claim 10, wherein the first configuration sub-circuit is configured to determine, according to a resolution of the first-type sub-display region, a position of the storage space for storing the display data for the first-type sub-display region, and generate and output the operation control signal according to the determined position of the storage space for storing the display data for the first-type sub-display region.

14. The display device of claim 10, further comprising: an application program terminal configured to output the partial screen display mode instruction to the driving circuit in response to a user operation.

15. The display device of claim 10, wherein the driving circuit is the driving circuit of claim 8, and the application program terminal is further configured to output the black insertion data for the second-type sub-display region to the driving circuit during m frames, m being greater than or equal to 1.

16. The display device of claim 15, wherein m equals to 1, 2, or 3.

* * * * *